US009773383B2

(12) United States Patent
Knebli

(10) Patent No.: US 9,773,383 B2
(45) Date of Patent: Sep. 26, 2017

(54) ALLOCATION OF JACKPOTS IN A LOTTERY GAME

(75) Inventor: Elizabeth Knebli, Toronto (CA)

(73) Assignee: INTERPROVINCIAL LOTTERY CORPORATION, Toronto, Ontario (CA)

( * ) Notice: Subject to any disclaimer, the term of this patent is extended or adjusted under 35 U.S.C. 154(b) by 132 days.

(21) Appl. No.: 12/501,803

(22) Filed: Jul. 13, 2009

(65) Prior Publication Data

US 2011/0009176 A1 Jan. 13, 2011

(51) Int. Cl.
*A63F 3/06* (2006.01)
*G07F 17/32* (2006.01)

(52) U.S. Cl.
CPC ..... *G07F 17/329* (2013.01); *G07F 17/32* (2013.01)

(58) Field of Classification Search
CPC ..... G07F 17/32; G07F 17/329
USPC ..... 463/25, 16, 18, 20
See application file for complete search history.

(56) References Cited

U.S. PATENT DOCUMENTS

| | | | | |
|---|---|---|---|---|
| 6,110,043 | A | 8/2000 | Olsen | |
| 6,203,010 | B1 | 3/2001 | Jorasch et al. | |
| 6,224,482 | B1 | 5/2001 | Bennett | |
| 6,241,608 | B1 | 6/2001 | Torango | |
| 6,656,048 | B2 | 12/2003 | Olsen | |
| 6,874,783 | B2 | 4/2005 | Higginson | |
| 6,887,152 | B2 | 5/2005 | Stanek | |
| 7,037,195 | B2 | 5/2006 | Schneider et al. | |
| 7,297,059 | B2 | 11/2007 | Vancura et al. | |
| 7,384,337 | B2 | 6/2008 | Thomas | |
| 7,442,122 | B2 | 10/2008 | Yaldoo et al. | |
| 2003/0114210 | A1* | 6/2003 | Meyer et al. | 463/17 |
| 2006/0172793 | A1* | 8/2006 | Desposito | 463/17 |
| 2006/0178194 | A1 | 8/2006 | Jubinville et al. | |
| 2006/0211465 | A1 | 9/2006 | Moshal | |
| 2007/0057461 | A1 | 3/2007 | Meyer et al. | |
| 2007/0287520 | A1 | 12/2007 | Nalker | |
| 2008/0020832 | A1 | 1/2008 | Iddings et al. | |

(Continued)

OTHER PUBLICATIONS

International Search Report for PCT/CA2010/000909 issued on Oct. 7, 2010.

(Continued)

*Primary Examiner* — David L Lewis
*Assistant Examiner* — Ross Williams
(74) *Attorney, Agent, or Firm* — Norton Rose Fulbright Canada LLP

(57) ABSTRACT

There is described a method of determining jackpots comprising the steps of: determining a total jackpot amount; determining whether the total jackpot amount is at least equal to a threshold, the threshold being equal to a maximum jackpot amount plus an excess jackpot amount; when the total jackpot amount is at least equal to the threshold, setting a main jackpot at the maximum jackpot amount, the main jackpot associated with a main draw; and determining a number of additional draws and corresponding additional jackpots, each to be won using a same player selection as for the main jackpot, using the excess jackpot amount, the corresponding additional jackpots being awarded independently of an allocation of the main jackpot, wherein at least one of the steps is performed by a processor.

25 Claims, 4 Drawing Sheets

(56) References Cited

U.S. PATENT DOCUMENTS

| | | | |
|---|---|---|---|
| 2009/0036192 | A1 | 2/2009 | Hughes |
| 2009/0088244 | A1 | 4/2009 | Nicely et al. |

OTHER PUBLICATIONS

"Extension Games" [online], http://www.scigames.com/sections/lottery-systems/extension- games.aspx, retrieved Jun. 11, 2009.
Canadian Intellectual Property Office, Examiner's Requisition Dated Oct. 23, 2013 issued in corresponding Canadian Patent Application No. 2,671,877.
Canadian Intellectual Property Office, Office Action dated Dec. 12, 2014 issued on Canadian Application No. 2671877.
Canadian Intellectual Property Office, Examiner's Requisition dated Feb. 8, 2016, issued in Canadian Patent Application No. 2,671,877.

* cited by examiner

ALLOCATION OF JACKPOTS IN A LOTTERY GAME

CROSS-REFERENCE TO RELATED APPLICATIONS

This is the first application filed for the present invention.

TECHNICAL FIELD

The present invention relates to the field of lottery games, and particularly to methods and systems for allocating jackpots.

BACKGROUND OF THE INVENTION

In a lottery game, a participant who can match the numbers drawn with those appearing on a previously purchased ticket will win the jackpot. If several participants match the numbers drawn, the jackpot pool is shared amongst the winners. In some cases, secondary prizes are also allotted for partial combinations of the winning numbers drawn.

A participant will be enticed to purchase a lottery ticket when the jackpot amount is high, and/or when he or she believes that there is a chance of winning. Various schemes or scenarios have been devised to incite the purchase of tickets by increasing the chances of winning. Other scenarios focus on bolstering the secondary prizes for partial combinations.

Corporations or entities that organize lottery draws are constantly looking for ways to encourage the purchase of lottery tickets. Therefore, there is a need for new methods or devices to increase tickets sales.

SUMMARY

According to a first broad aspect, there is provided a method of determining jackpots comprising the steps of: determining a total jackpot amount; determining whether the total jackpot amount is at least equal to a threshold, the threshold being equal to a maximum jackpot amount plus an excess jackpot amount; when the total jackpot amount is at least equal to the threshold, setting a main jackpot at the maximum jackpot amount, the main jackpot associated with a main draw; and determining a number of additional draws and corresponding additional jackpots each to be won using a same player selection as for the main jackpot, using the excess jackpot amount, the corresponding additional jackpots being awarded independently of an allocation of the main jackpot.

In at least one embodiment of the above-described method, at least one of the steps is performed by a processor.

In accordance with a second broad aspect, there is provided a jackpot determining machine comprising: a memory for storing a total jackpot amount; and a processor in communication with the memory, the processor being configured for performing the steps of: determining whether the total jackpot amount is at least equal to a threshold, the threshold being equal to a maximum jackpot amount plus an excess jackpot amount; when the total jackpot amount is at least equal to the threshold, setting a main jackpot at the maximum jackpot amount, the main jackpot associated with a main draw; and determining a number of additional draws and corresponding additional jackpots each to be won using a same player selection as for the main jackpot, using the excess jackpot amount, the corresponding additional jackpots being awarded independently of an allocation of the main jackpot.

In accordance with a further embodiment, there is provided a computer readable memory having recorded thereon statements and instructions for execution by a computer to carry out the steps of: determining a total jackpot amount; determining whether the total jackpot amount is at least equal to a threshold, the threshold being equal to a maximum jackpot amount plus an excess jackpot amount; when the total jackpot amount is at least equal to the threshold, setting a main jackpot at the maximum jackpot amount, the main jackpot associated with a main draw; and determining a number of additional draws and corresponding additional jackpots each to be won using a same player selection as for the main jackpot, using the excess jackpot amount, the corresponding additional jackpots being awarded independently of an allocation of the main jackpot.

In accordance with yet another embodiment, there is provided a network executing a software process for allocating jackpots, the network containing at least one computer, the at least one computer configured for: determining a total jackpot amount; determining whether the total jackpot amount is at least equal to a threshold, the threshold being equal to a maximum jackpot amount plus an excess jackpot amount; when the total jackpot amount is at least equal to the threshold, setting a main jackpot at the maximum jackpot amount, the main jackpot associated with a main draw; and determining a number of additional draws and corresponding additional jackpots each to be won using a same player selection as for the main jackpot, using the excess jackpot amount, the corresponding additional jackpots being awarded independently of an allocation of the main jackpot.

The expression "draw session" refers to the draws performed to allocate a lottery pool. A draw session can comprise a single draw. Alternatively, a draw session can comprise a main draw and at least one additional draw.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION

In a lottery game, a pool is to be shared between winners. Usually, the pool is shared among a main prize and secondary prizes which are less important than the main prize. The main prize is referred to as the jackpot.

Figure 1:
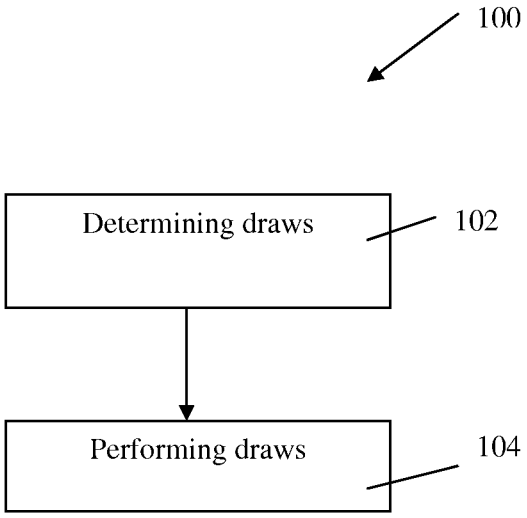
FIG. 1 is a flow chart of a method for determining lottery winners, in accordance with an embodiment.

FIG. 1 illustrates a method 100 for performing draws in a lottery game. The first step 102 consists in determining jackpots. In this step, the number of jackpots and their associated amounts are determined. Once the jackpots have been determined, the next step 104 is to perform at least one draw in accordance with the determined jackpots in order to determine winning selections. The number of draws is equal to the number of the determined jackpots.

In an alternative embodiment, a first or main draw occurs before jackpots are determined. If the draw session involves secondary prizes, these prizes are allocated and a number of additional draws are then determined as a function of the remaining amounts for any subsequent jackpots. This will be explained in more detail further below.

In one embodiment, all of the available prizes are monetary amounts. Alternatively, the prizes can comprise monetary amounts, free participations, vacations, merchandise and the like. It should be understood that the pool can comprise any prizes which can be associated with a monetary amount. For example, a free participation to a next lottery draw can be estimated to the fee of one participation or lower.

In one embodiment, a single prize, namely the jackpot is available and the entire pool is associated with the jackpot. In this case, a single draw is performed to provide a single winning selection and the jackpot is shared between the players having the winning selection. In another embodiment, the prizes comprise a jackpot and at least one secondary prize. In this case, a single draw is performed to provide a single winning selection. The jackpot is associated with the entirety of the winning selection and each secondary prize is associated with a portion of the winning selection. While the jackpot comprises a monetary amount, the secondary prizes are not limited to monetary amounts. For example, a secondary prize can be a free participation to a next draw session. In the case where more than one secondary prize is present, the secondary prizes may be ranked as a function of their monetary value. The first secondary prize has a higher monetary value than the second secondary prize which has a higher monetary value than the third secondary prize, etc.

Figure 2:
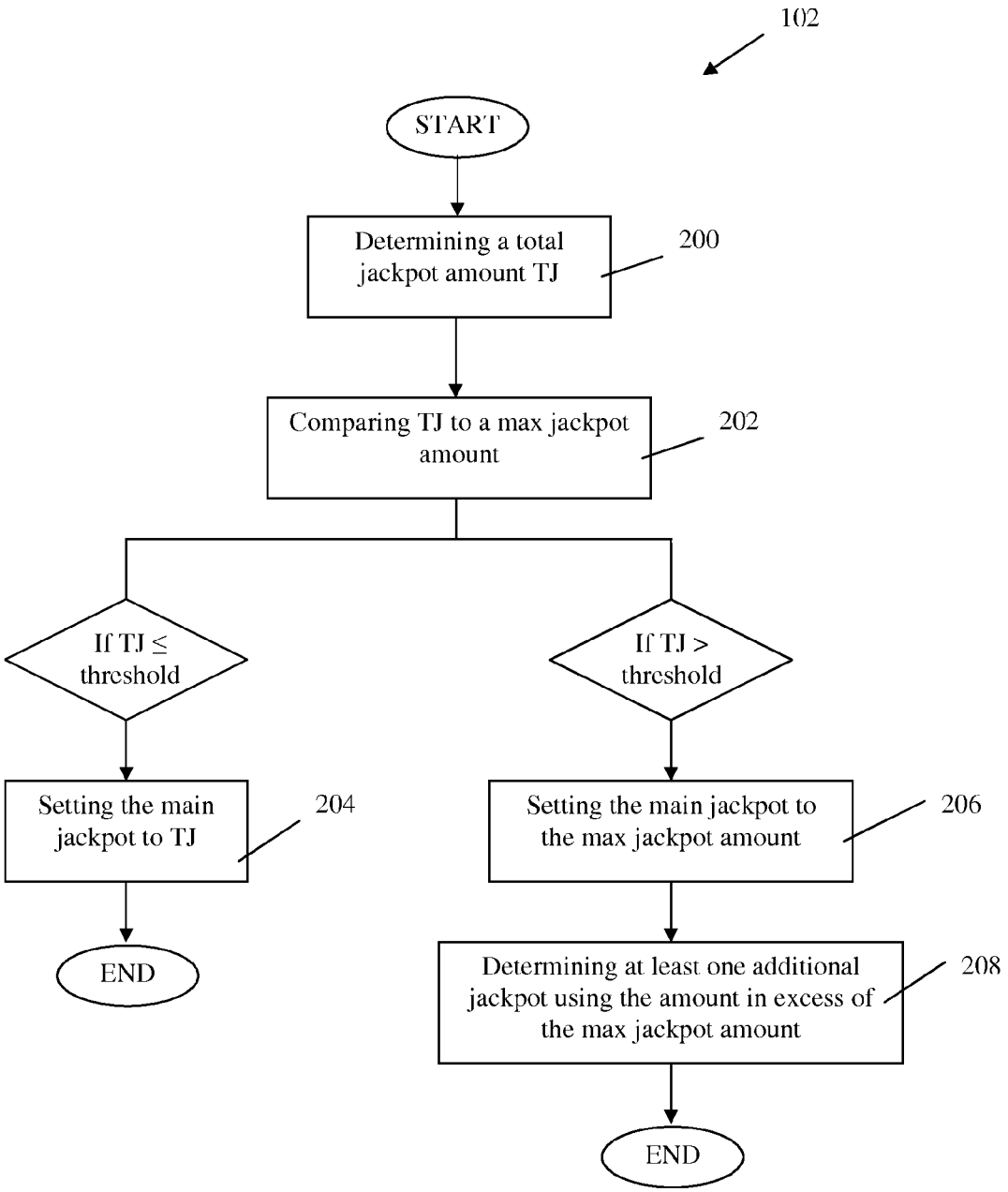
FIG. 2 is a flow chart of a method for determining jackpots using a single threshold, in accordance with an embodiment.

FIG. 2 illustrates one embodiment of the method 102 for determining jackpots. The first step 200 consists in determining a total jackpot amount. The total jackpot amount is the monetary amount to be shared between winners having the jackpot winning selection. If there is no secondary prize, the total jackpot amount is the entire pool of the lottery game. Otherwise, if there are secondary prizes, the total jackpot amount allocated to the jackpot is a portion of the pool and the remaining of the pool is distributed among the secondary prizes. At step 204, the total jackpot amount is compared to a predetermined threshold. In this embodiment, the threshold is a maximum jackpot amount. The maximum jackpot amount is a predetermined maximum limit for the jackpot. If the total jackpot amount is inferior or equal to the maximum jackpot amount, a single jackpot is set at the total jackpot amount (step 204) and no additional draws will subsequently be performed to determine winners of additional jackpots. In this case, the draw session consists of a single draw. If the total jackpot amount is superior to the threshold, then a main jackpot amount is set to the maximum jackpot amount (step 206) for a main draw. The amount of the total jackpot in excess of the maximum jackpot amount, namely the difference between the total jackpot amount and the maximum jackpot amount, is then used to determine at least one additional draw (step 208). Subsequently, at least one additional draw independent of the main draw will be performed to determine the winning selections for the additional jackpot(s). In this case, the draw session consists of the main draw and the additional draw(s). For example, the maximum jackpot amount is set at 50 million dollars. If the total jackpot amount is equal to 30 million dollars, then a single jackpot is set at 30 million dollars. However, if the total jackpot amount is equal to million dollars, then a main jackpot is set at the maximum jackpot amount, namely 50 million dollars, and the remaining two million dollars are used to determine at least one additional jackpot. The additional jackpots are determined in accordance with additional jackpot amounts or with a number of additional jackpots.

In an alternative embodiment, part of the excess of the maximum jackpot amount may be used to increase the main jackpot amount beyond the threshold, while the remaining part is used for at least one additional draw. For example, if the threshold is 50 million dollars and the total jackpot amount is 60 million dollars, 5 million may be added to the main jackpot, bringing the total to 55 million, and 5 million may be split among additional jackpot amounts of 1 million each. In this case, the draw session would consist of 6 draws. These numbers are simply to illustrate the principle and the amounts may be split in a variety of ways, without being limited to a 50-50 split.

Figure 3:
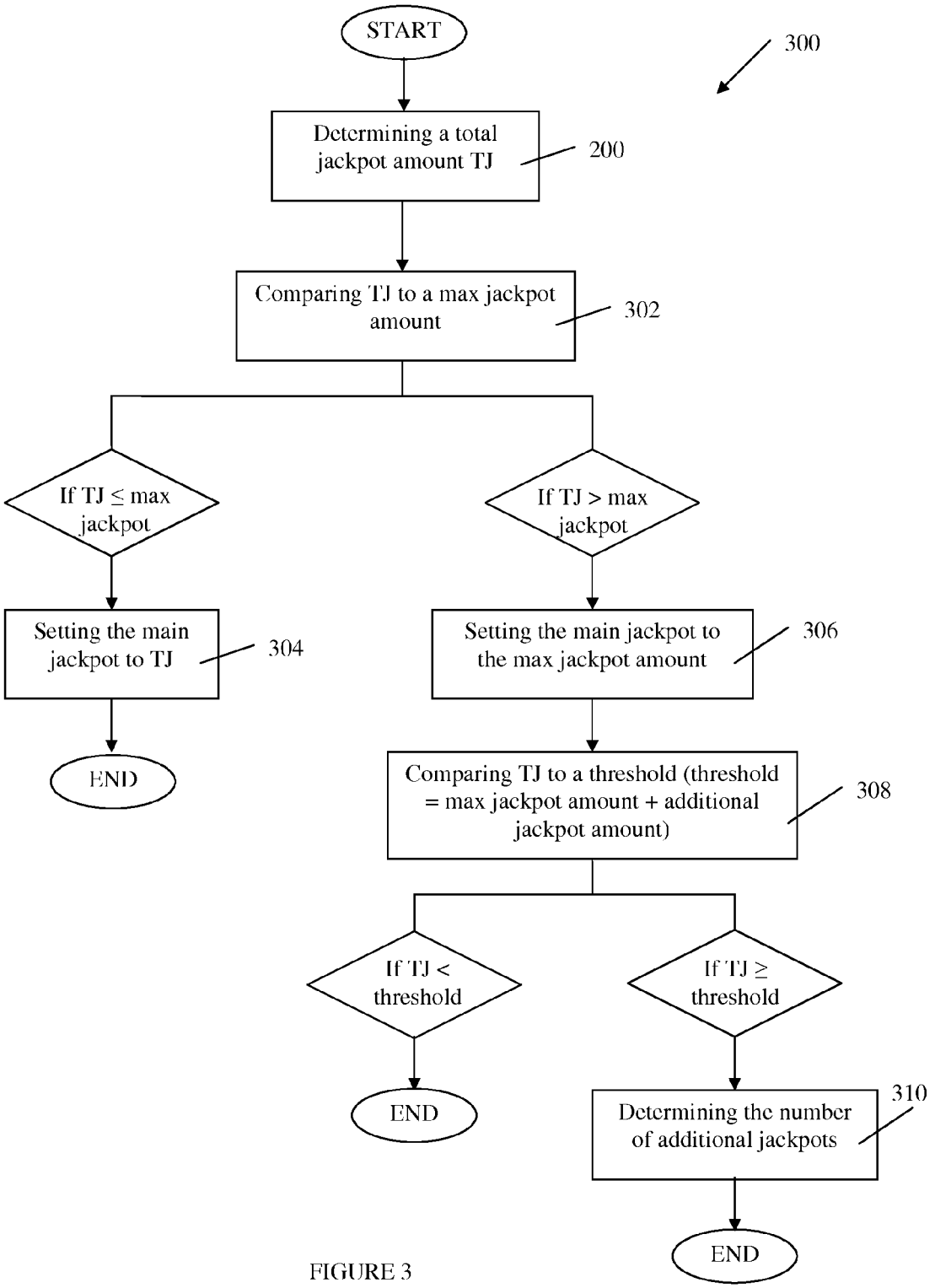
FIG. 3 is a flow chart of a method of determining jackpots using two thresholds, in accordance with an embodiment.

FIG. 3 illustrates one embodiment of a method 300 for determining jackpots in accordance with predetermined additional jackpot amounts. In this embodiment, all of the additional jackpot amounts have the same value. The first step 200 consists in determining a total jackpot amount. At step 302, the total jackpot amount is compared to a first threshold, namely the maximum jackpot amount. If the total jackpot amount is inferior or equal to the maximum jackpot amount, a single jackpot is set for the total jackpot amount (step 304) for a single draw. If the total jackpot amount is superior to the maximum jackpot amount, then a main jackpot is set for the maximum jackpot amount (step 306) for a main draw. The next step 308 consists in comparing the total jackpot amount to a second threshold. The second threshold corresponds to the maximum jackpot amount plus the additional jackpot amount. If the total jackpot amount is inferior to the second threshold, i.e. if the amount of the total jackpot amount in excess of the maximum jackpot amount is inferior to the additional jackpot amount, then no further step is performed and the draw session consists in only a single draw, i.e. the main draw. The jackpot excess amount can be transferred to a secondary prize, if any, or to the pool of the next draw session. If the total jackpot amount is superior or equal to the second threshold, i.e. if the amount of the total jackpot amount in excess of the maximum jackpot amount is superior or equal to the additional jackpot amount, the next step 310 consists in determining the number of additional draws required to allocate the excess amount. The excess amount is divided by the additional jackpot amount and the number of additional jackpots is given by the quotient of the division. Each additional draw is associated with the additional jackpot amount. For each additional jackpot, an additional draw will be performed to determine winners of the corresponding additional jackpot. For example, the maximum jackpot amount is set at 50 million dollars and the additional jackpot amount is set at 1 million dollars. If the total jackpot amount is equal to 30 million dollars, then a single jackpot is set at 30 million dollars. If the total jackpot amount is equal to 50.5 million dollars, then a single jackpot is set at the maximum jackpot amount, i.e. 50 million dollars. The remaining amount of the total jackpot amount, namely the 500,000 dollars, is less than the additional jackpot amount and can be transferred to at least one secondary prize of the main draw, if any, or to the pool of the next draw session. If the total jackpot amount is equal to 52 million dollars, then a main jackpot is set at the maximum jackpot amount, namely 50 million dollars. The remaining amount of the total jackpot amount, i.e. 2 million dollars, is divided by the additional jackpot amount, i.e. 1 million dollars, in order to calculate the number of additional draws. In this case, two additional draws will subsequently be performed to determine the winners of the two additional jackpots. In this case, the draw session comprises three draws, i.e. the main draw and the two additional draws. If the total jackpot amount is equal to 52.1 million dollars, then a main jackpot is set at the maximum jackpot amount, i.e. 50 million dollars. The remaining amount of the total jackpot amount, i.e. 2.1 million dollars, is divided by the additional jackpot amount, namely 1 million dollars, in order to calculate the number of additional jackpots. The number of additional draws is equal to the quotient of the division, namely 2. The remaining 100,000 dollars can be transferred to the at least one secondary prize of the main draw, if any, or to the pool of a next lottery event. In this case, the draw session comprises three draws, i.e. the main draw and the two additional draws.

While FIG. 3 refers to additional jackpots having the same additional jackpot amount, it should be understood that the additional jackpot amount may vary from one additional jackpot to another. For example, a first additional jackpot amount may be set at 1 million dollars, a second additional jackpot may be set at 2 million dollars, and the next additional jackpot amounts may each be set at 3 million dollars. The first additional jackpot is used to determine the threshold. In this case, if the total jackpot amount is 56 million dollars, then four draws are necessary for distributing the total jackpot amount among winners. The main draw is associated with a 50 million dollar jackpot. A first additional draw is associated with a 1 million dollar jackpot. A second additional draw is associated with a 2 million dollar jackpot and a third additional draw is associated with a 3 million dollar jackpot. Alternatively, the first additional jackpot amount may be set at 3 million dollars, the second additional jackpot may be set at 2 million dollars, and the next additional jackpot amounts may each be set at 1 million dollars.

In one embodiment, the additional jackpots are determined in accordance with a predetermined number of additional draws. The number of additional draws is predetermined and the excess money is shared between the additional draws. The distribution of the excess money between the additional jackpots can be performed randomly or according to a predetermined sharing scheme. For example, a predetermined portion of the excess amount is allocated to each additional jackpot. For example, there can be three additional jackpots and the sharing scheme can be the following: 50%, 25%, and 25%. The first additional jackpot is set to 50% of the excess amount while the second and third additional jackpot are each set to 25% of the excess amount. Referring back to the previous example, the first additional jackpot is then set to 1 million dollars while the second and third additional jackpots are each set to 500,000 dollars. It should be understood that the number of additional jackpots and the sharing scheme illustrated above are exemplary only. For example, the number of additional jackpots can be equal to one or two, or superior to three, and the excess money can be evenly shared between the additional draws.

While the previous embodiments refer to the determination of draws in accordance with either a predetermined number of additional draws or with predetermined additional jackpot amounts, the determination of the additional jackpots can be performed randomly. In a first example, the number of additional jackpots is determined randomly within a predetermined range. For example, the predetermined range can be [1, 5], i.e. the number of additional jackpots can take any value from 1 to 5. The excess amount of the total jackpot is then distributed between the additional jackpot amounts either evenly or according to a predetermined distribution scheme. In a second example, the additional jackpot amounts are determined randomly within a predetermined range. For example, if the excess amount of the total jackpot is 2.4 million dollars, a first additional random amount is randomly determined within the range comprised between 1 million dollars and 1.2 million dollars. For example, the first additional jackpot amount is set at 1.1 million dollars. The excess amount is then 1.3 million dollars. A second additional jackpot amount is determined randomly and set at 1.2 million dollars. As the excess amount is then 0.1 million dollars, there is no third additional jackpot. The predetermined ranges may vary as a function of the excess jackpot amount.

Referring back to FIG. 1, step 104 consists in performing the number of draws corresponding to the number of previously determined jackpots. If the determination of the jackpots (step 102) results in a single jackpot, then a single draw is performed. The single draw provides the winning selection and the single jackpot and the secondary prizes, if any, are distributed in accordance with the winning selection. If at least one additional draw has been determined, a main draw and an additional draw for each additional jackpot are independently performed. The main draw provides the winning selection for the main jackpot and the secondary prizes, if any. Each additional draw provides a new single winning selection and the additional jackpots are allocated in accordance with their corresponding winning selection. Then the number of winners for each draw is determined. With respect to the main draw, the winners are the holders of at least part of the drawn winning selection. A winner can win the jackpot or a secondary prize. If more than one player has the same winning selection, the corresponding prize is shared among the winners. In the case of an additional draw, only the players having the entire jackpot winning selection are winners since there is no secondary prize.

Alternatively to the flowchart of FIG. 1, a first or main draw is performed, jackpots are determined, and additional draws are subsequently performed accordingly.

In order to participate in the lottery game, a player buys a ticket which comprises at least one selection. The selection may be chosen by the player or randomly generated when the player is buying the lottery ticket. Each selection of the lottery ticket allows the player to participate in all of the draws including the main draw and the additional draws, if any, and each selection of the lottery ticket provides the player with a chance to win the main jackpot and the additional jackpots, if any. Taking the example of a lottery ticket comprising a single selection, the single selection is compared to the winning selection of the main draw in order to determine if the owner of the lottery ticket wins the main jackpot or another prize associated with the main draw. If the total jackpot amount allows additional draws, the single selection is also compared to the winning selection of each one of the additional draws. If the single selection corresponds to the winning selection of one of the additional draws, the owner of the lottery ticket wins the additional jackpot associated with the corresponding additional draw. In another example, each lottery ticket comprises three selections. In this case, each one of the three selections provides the holder of the lottery ticket with a participation in all of the draws of a draw session. For example, if two additional draws have been determined in addition to the main draw, each one of the three selections are compared to the winning selection of the main draw and the winning selections of the additional draws in order to determine if the player wins a prize. As a result, a same selection provides the player with a participation in the main draw and also in the additional draws.

It should be understood that when the total jackpot amount allows for at least one additional draw, the additional draws are performed even if the main jackpot is not won. The allocation of the additional jackpots are independent of an allocation of the main jackpot.

It should be understood that the draws can be performed manually or automatically by a machine having a processor configured for randomly determining selections. For example, when additional draws are to take place, the main draw may be performed manually and the additional draws may be performed automatically by the machine.

The following illustrates an exemplary standard lottery game. This standard lottery game is one example of a lottery game in which additional draws may be performed to allocate the lottery pool to winners. Each draw session consists of at least one main draw. For the main draw, seven main numbers in addition to one bonus number are drawn at random. These eight numbers are all different and drawn from among all numbers from one to forty-nine. Table 1 illustrates an example of winning selections.

TABLE 1

| Winning selections | Definition |
|---|---|
| 7/7 (JACKPOT) | The seven main numbers |
| 6/7+ | Any six main numbers and the bonus number |
| 6/7 | Any six main numbers and one other number |
| 5/7 | Any five main numbers and two other numbers or any five main numbers, one other number, and the bonus number |
| 4/7 | Any four main numbers and three other numbers or any four main numbers, two other numbers, and the bonus number |
| 3/7+ | Any three main numbers, the bonus number and three other numbers |
| 3/7 | Any three main numbers and four other numbers |

The term "other number" refers to any number which has not been drawn. A prize is associated with each winning selection. The monetary value of a prize may be predetermined. For example, the prize associated with the jackpot selection (7/7 winning selection) can be fixed. Alternatively, the monetary value of a prize can be a predetermined percentage of the pool. In this case, the jackpot prize is shared between all winners having the 7/7 winning selection. In another example, each winner having the 3/7 winning selection wins a free play for a next draw session.

As un-won prizes are transferred to the pool of a next draw session, the pool of the lottery can increase from one draw session to the next. In this example, the maximum jackpot amount is set to 50 million dollars and the additional jackpot amount is predetermined and set at 1 million dollars. A threshold is defined as the sum of the maximum jackpot amount and the additional jackpot amount. In this case, the threshold is set at 51 million dollars. If the total jackpot amount, namely the prize associated with the 7/7 winning selection, is equal to 35 million dollars, then a single jackpot is set at 35 million dollars and a single draw is performed. The draw provides seven main numbers and one bonus number. The total jackpot amount is shared between all of the winners having the seven drawn main numbers. The remaining of the lottery pool is shared between the winners of the secondary winning selections as illustrated in table 1. For example, the prize associated with the 6/7+ winning selection is shared between winners having any six drawn main numbers in addition to the drawn bonus number. In another example, any winner having any three drawn main numbers receives a free participation for a next draw session.

If the total jackpot amount is equal to 50.5 million dollars, then the total jackpot amount is superior to the maximum jackpot amount but inferior to the threshold. In this case, a single jackpot to be shared between winners of the 7/7 winning selection is set at the maximum jackpot amount, i.e. 50 million dollars. The amount of the total jackpot amount in excess of the maximum jackpot amount, i.e. 500,000 dollars, is transferred and added to the prize associated with the 6/7+ winning selection. If no player wins the winning 6/7+ selection, the amount for the 6/7+ winner is transferred to the pool of the next draw session. The remaining of the lottery pool is allocated among the winners of the secondary prizes.

If the total jackpot amount is equal to 53.1 million dollars, then the total jackpot amount is superior to the threshold and more than one jackpot is to be determined. The main jackpot is set at the maximum jackpot amount, namely 50 million dollars. The number of additional jackpots is given by the quotient of the division of the total jackpot amount minus the maximum jackpot amount by the additional jackpot amount. It results in three additional jackpots of one million dollars each. The remainder of the division, i.e. 100,000 dollars, is transferred and added to the prize associated with the 6/7+ winning selection of the main draw. If no player wins the 6/7+ winning selection of the main draw, the amount for the 6/7+ winner is transferred to the pool of the next draw session or to a subsequent secondary prize. Three additional draws are then performed. For the main draw, seven main numbers and one bonus number are drawn while only seven main numbers are drawn for each additional draw since no secondary prizes are associated with an additional draw. The winners of the 7/7 selection of the main draw share the 50 million dollar jackpot while the winners of the 7/7 winning selection of each additional draw share the corresponding additional jackpot amount. The remaining of the lottery pool is shared among winners of secondary prizes of the main draw. If a jackpot is not won, its associated amount is transferred to the pool of the next draw session or to a secondary prize. In addition, if a main jackpot is won but one or more additional jackpots are not won, the un-won additional jackpot amounts may be transferred to a next draw session and allocated to a future main jackpot.

In one embodiment, each lottery ticket comprises three selections and each selection includes seven numbers comprised between 1 and 49. For example, a player buys a lottery ticket comprising the three following selections:

First selection: 4, 26, 34, 35, 42, 45, 47;

Second selection: 6, 12, 20, 23, 28, 32, 34;

Third selection: 13, 15, 19, 26, 45, 46.

The total jackpot amount is 52 million dollars and the maximum jackpot amount is set at 50 million dollars so that one main draw and two additional draws are performed. The jackpot associated with the main draw is set at the maximum jackpot amount, namely 50 million dollars, and each one of the two additional draws is associated with a one million dollar jackpot.

A main draw is performed and the 7/7 winning selection associated with the main draw is the following: 6, 10, 23, 30, 32, 40, 44 with a bonus number equal to 49. Each one of the two additional draws is performed independently of the main draw. The 7/7 winning selection associated with the first additional draw is: 6, 12, 20, 23, 28, 32, 34. The 7/7 winning selection associated with the second additional draw is: 3, 7, 8, 13, 15, 19, 41. Since the first player selection comprises no numbers from the 7/7 winning selection associated with the main draw and the two additional draws, no prize is associated with the first player selection. Since the second player selection has three numbers, i.e. 6, 23, and 32, in common with the 7/7 winning selection associated with the main draw, the player wins the prize associated with the 3/7 winning selection, i.e. a free participation for a next draw session, for example. Furthermore, since the second player selection is identical to the 7/7 winning selection associated with the first additional draw, the player wins the jackpot associated with the first additional draw, i.e. one million dollars. It should be understood that if at least two players have the 7/7 winning selection, the 1 million dollar jackpot is shared between the winners of the first additional draw. Finally, the player wins no prize with respect to the third selection since the third player selection comprises no number from the 7/7 winning selections associated with the main draw and the first and second additional draws.

Figure 4:
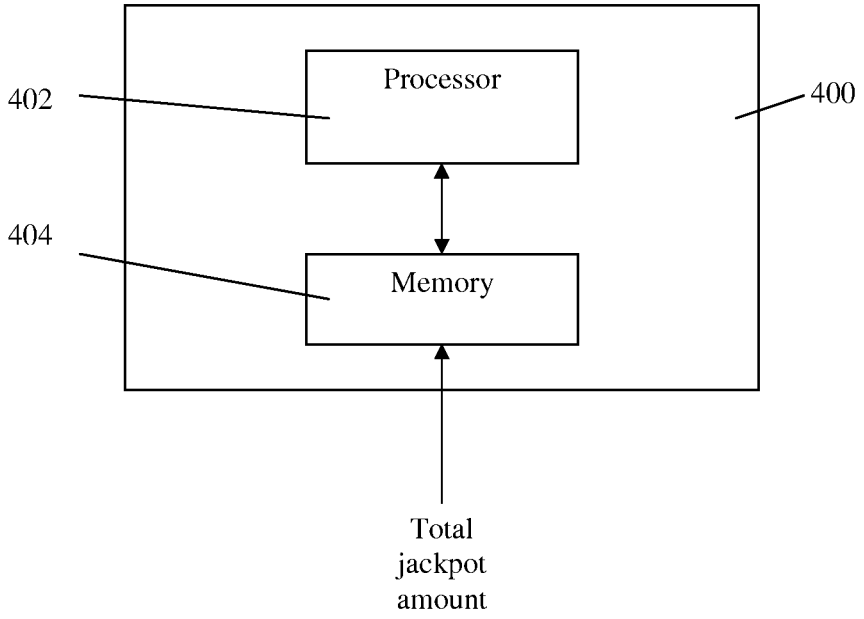
FIG. 4 is a block diagram of jackpot determining device, in accordance with an embodiment.

FIG. 4 illustrates one embodiment of a jackpot determining machine 400 for determining jackpots in a lottery game. The machine 400 comprises a processor 402 in communication with a memory 404. The system 400 receives a maximum jackpot amount and a total jackpot amount, and stores them into memory 404. The processor is adapted to access the memory and perform the steps of the method 102 illustrated in FIG. 2 in order to determine draw characteristics, i.e. the number of draws and the jackpot amount associated with each draw.

In one embodiment, the system 400 is adapted to determine the number of draws using a fixed and predetermined additional jackpot amount. The system 400 receives the additional jackpot amount as input and stores it into memory 404. In this case, the processor 402 is configured for performing the steps of the method illustrated in FIG. 3.

In another embodiment, the processor is configured for determining additional jackpot amounts in accordance with a fixed number of additional jackpots in accordance with the method described above. In this embodiment, the system 400 receives the number of additional jackpots and stores it into memory 404. The processor 402 accesses the stored number of additional jackpots and determines the additional jackpot amount associated with each additional jackpot. Alternatively, the processor may be configured for determining jackpots in accordance with a random method described above.

In one embodiment, a user inputs the total jackpot amount into the jackpot determining device 400. Alternatively, the jackpot determining device 400 can be provided with communication means and the total jackpot amount is received via the communication means.

In one embodiment, the jackpot determining device 400 receives sales estimations and the processor is configured for determining the total jackpot amount using the sales estimations. In this embodiment, the processor can also be configured for adjusting the total jackpot in accordance with real sales values once the sales are completed. The jackpot determining device 400 can be in communication with retailers which periodically send sales information to the device 400. In an alternative embodiment, the jackpot determining device 400 receives the total jackpot amount after a first draw has been performed and secondary prizes have been allocated. The remaining amount is then considered in determining if additional draws are to occur.

In one embodiment, the method for determining jackpots is performed by a server connected to a network such as the Internet and the lottery game is an Internet lottery. In this case, the processor of the server is configured for performing the steps of the method. In this embodiment, the processor of the server may also be configured for performing the draws.

It should be understood that a selection can be any series of figures, numbers, symbols, letters, playing cards, and the like. A series comprises at least one element. A selection can also be a combination of numbers, symbols, letters, playing cards, and the like.

In one embodiment, the method for determining the number of additional draws and their corresponding additional jackpot is embodied in a computer readable memory. The computer readable memory has recorded thereon statements and instructions for execution by a computer to carry out the method for determining draws described above.

While the blocks of the methods in the figures are shown as occurring in a particular order, it will be appreciated by those skilled in the art that many of the blocks are interchangeable and may occur in different orders than that shown without materially affecting the end results of the methods. While the present disclosure is primarily described as a method, a person of ordinary skill in the art will understand that the present disclosure is also directed to an apparatus for carrying out the disclosed method and including apparatus parts for performing each described method block, be it by way of hardware components, a computer programmed by appropriate software to enable the practice of the disclosed method, by any combination of the two, or in any other manner. Moreover, an article of manufacture for use with the apparatus, such as a pre-recorded storage device or other similar computer readable medium including program instructions recorded thereon, or a computer data signal carrying computer readable program instructions may direct an apparatus to facilitate the practice of the disclosed method. It is understood that such apparatus, articles of manufacture, and computer data signals also come within the scope of the present disclosure.

The embodiments of the present disclosure described above are intended to be examples only. Those of skill in the art may effect alterations, modifications and variations to the particular example embodiments without departing from the intended scope of the present disclosure. In particular, selected features from one or more of the above-described example embodiments may be combined to create alternative example embodiments not explicitly described, features suitable for such combinations being readily apparent to persons skilled in the art. The subject matter described herein in the recited claims intends to cover and embrace all suitable changes in technology.

I claim:

1. A computer-implemented method for providing a centralized lottery provisioning unit using an electronic remote networked jackpot determining device configured for distributing lottery information over a communication network and electronically coupled to remote retailer devices, the method comprising:

maintaining an electronic record representing a pool of available winnings on non-transitory computer readable memory;

receiving, as an input into the remote networked jackpot determining device from the remote retailer devices over the communication network, communications including retailer sales information representing, in concert, overall sales for a lottery, the remote retailer devices comprising:

a ticket generator configured to generate physical lottery tickets, each physical lottery ticket encoding a set of elements forming a player selection, and a network communication interface for communicating at least the retailer sales information to the electronic remote networked jackpot determining device;

automatically determining a total jackpot amount based on the received sales information;

determining whether said total jackpot amount is at least equal to a threshold, said threshold being equal to a maximum jackpot amount plus an excess jackpot amount;

when said total jackpot amount is at least equal to said threshold, setting a main jackpot at said maximum jackpot amount, said main jackpot associated with a main draw; and determining a number of additional draws and corresponding additional jackpots, each to be won using the same set of elements forming the player selection for entering in said main draw, using said excess jackpot amount, each additional jackpot being awarded for its corresponding additional draw regardless of whether the main jackpot is won and independently of other additional draws or jackpots;

configuring a random number generator to generate random numbers to create a winning selection for each of the number of additional draws;

communicating the winning selection for each of the number of additional draws for comparison with the set of elements of generated physical lottery tickets;

updating the electronic record representing the pool of available winnings based at least on the winning selections for each of the additional draws, the pool increasing or decreasing in size responsive to winnings of the additional draws and the main jackpot.

2. The method as claimed in claim 1, wherein the sales information includes sales estimations and wherein determining said total jackpot is based on said sales estimations.

3. The method as claimed in claim 2, further comprising adjusting said total jackpot amount using completed sales values.

4. The method as claimed in claim 2, wherein said determining said total jackpot amount comprises determining said total jackpot amount using an un-won jackpot carried over from a previous draw session.

5. The method as claimed in claim 1, wherein said determining a number of additional draws and corresponding additional jackpots comprises determining said number of said additional draws in accordance with a fixed additional jackpot amount.

6. The method as claimed in claim 5, wherein said determining said number of said additional draws comprises dividing said excess jackpot amount by said fixed additional jackpot amount to obtain a quotient and a remainder, said number of said additional draws corresponding to said quotient.

7. The method as claimed in claim 6, further comprising applying said remainder to a secondary prize of said main draw.

8. The method as claimed in claim 1, wherein said determining a total jackpot amount comprises determining said total jackpot amount after said main draw has occurred and secondary prizes for said main draw have been allocated.

9. The method as claimed in claim 1, wherein said determining a number of additional draws and corresponding additional jackpots comprises determining said corresponding additional jackpots in accordance with a fixed number of said additional draws.

10. The method as claimed in claim 9, wherein said determining said corresponding additional jackpots comprises evenly distributing said excess jackpot amount amongst said additional jackpots.

11. The method as claimed in claim 1, further comprising performing said main draw and said additional draws.

12. The method as claimed in claim 11, wherein performing said main draw comprises randomly drawing at least seven main numbers.

13. The method as claimed in claim 11, wherein performing said additional draws comprises randomly drawing seven main numbers for each one of said additional draws.

14. A remote networked jackpot determining machine for distributing lottery information over a communication network, the remote networked jackpot determining machine comprising:

a memory maintaining an electronic record representing a pool of available winnings; and an automated secondary jackpot provisioning processor in communication with said memory, said automated secondary jackpot provisioning processor providing a centralized lottery provisioning unit electronically coupled to remote retailer devices, the processor being configured for:

receiving as an input, from the remote retailer devices over the communication network, a plurality of electronic communications including retailer sales information representing, in concert, overall sales for a lottery, each of the remote retailer devices comprising:

a ticket generator configured to generate physical lottery tickets, each physical lottery ticket encoding a set of elements forming a player selection, and a network communication interface for communicating at least the retailer sales information to the remote networked jackpot determining machine;

storing the received sales information in the memory;

automatically determining a total jackpot amount based on the received sales information;

determining whether said total jackpot amount is at least equal to a threshold, said threshold being equal to a maximum jackpot amount plus an excess jackpot amount;

when said total jackpot amount is at least equal to said threshold, setting a main jackpot at said maximum jackpot amount, said main jackpot associated with a main draw; and determining a number of additional draws and corresponding additional jackpots, each to be won using the same set of elements forming the player selection as for entering in said main draw, using said excess jackpot amount, each additional jackpot being awarded for its corresponding additional draw regardless of whether the main jackpot is won and independently of other additional draws or jackpots;

configuring a random number generator to generate random numbers to create a winning selection for each of the number of additional draws;

communicating the winning selection for each of the number of additional draws for comparison with the set of elements of generated physical lottery tickets; and updating the electronic record representing the pool of available winnings based at least on the winning selections for each of the additional draws, the pool increasing or decreasing in size responsive to winnings of the additional draws and the main jackpot.

15. The remote networked jackpot determining machine as claimed in claim 14, wherein said processor is further configured for determining said total jackpot amount using sales estimations.

16. The remote networked jackpot determining machine as claimed in claim 15, wherein said processor is further configured for adjusting said total jackpot amount using completed sales values.

17. The remote networked jackpot determining machine as claimed in claim 16, further comprising communication means connected to said processor for receiving said sales estimations and said completed sales values.

18. The remote networked jackpot determining machine as claimed in claim 14, wherein said processor is configured for determining said number of said additional draws in accordance with a fixed additional jackpot amount.

19. The remote networked jackpot determining machine as claimed in claim 18, wherein said processor is configured for dividing said excess jackpot amount by said fixed additional jackpot amount to obtain a quotient and a remainder, said number of said additional draws corresponding to said quotient.

20. The remote networked jackpot determining machine as claimed in claim 19, wherein said processor is configured for applying said remainder to a secondary prize of said main draw.

21. The remote networked jackpot determining machine as claimed in claim 14, wherein said processor is configured for determining said total jackpot amount after said main draw has occurred and secondary prizes for said main draw have been allocated.

22. The remote networked jackpot determining machine as claimed in claims 14, wherein said processor is configured for determining said corresponding additional jackpot in accordance with a fixed number of said additional draws.

23. The remote networked jackpot determining machine as claimed in claim 22, wherein said processor is configured for evenly distributing said excess jackpot amount amongst said additional jackpots.

24. A computer readable memory having recorded thereon statements and instructions for distributing lottery information over a communication network, the statements and instructions for execution by a remote networked jackpot determining machine providing a centralized lottery provisioning unit and electronically coupled to remote retailer devices to carry out the steps of:

maintaining an electronic record representing a pool of available winnings on non-transitory computer readable memory;

receiving, as an input into the remote networked jackpot determining machine from the remote retailer devices over a communication network, communications including retailers sales information, the remote retailer devices comprising:

a ticket generator configured to generate physical lottery tickets, each physical lottery ticket encoding a set of elements forming a player selection, and a network communication interface for communicating at least the retailer sales information to the remote networked jackpot determining machine;

automatically determining a total jackpot amount based on the received sales information;

determining whether said total jackpot amount is at least equal to a threshold, said threshold being equal to a maximum jackpot amount plus an excess jackpot amount;

when said total jackpot amount is at least equal to said threshold, setting a main jackpot at said maximum jackpot amount, said main jackpot associated with a main draw; and determining a number of additional draws and corresponding additional jackpots, each to be won using the same set of elements forming the player selection as for entering in said main draw, using said excess jackpot amount, each additional jackpot being awarded for its corresponding additional draw regardless of whether the main jackpot is won and independently of other additional draws or jackpots;

configuring a random number generator to generate random numbers to create a winning selection for each of the number of additional draws;

communicating the winning selection for each of the number of additional draws for comparison with the set of elements of generated physical lottery tickets;

and updating the electronic record representing the pool of available winnings based at least on the winning selections for each of the additional draws, the pool increasing or decreasing in size responsive to winnings of the additional draws and the main jackpot.

25. A system for providing a centralized lottery provisioning unit configured for distributing lottery information over a communication network, a system comprising:

a memory maintaining an electronic record representing a pool of available winnings;

the communication network;

a plurality of remote retailer devices comprising:

a ticket generator configured to generate physical lottery tickets, each physical lottery ticket encoding a set of elements forming a player selection, a processor configured to generate retailer sales information, and a network communication interface for communicating the sales information over the communication network; and an automated secondary jackpot provisioning server comprising at least one processor configured for:

receiving, over the communication network, at least the retailer sales information from the plurality of remote retailer devices representing, in concert, overall sales for a lottery;

automatically determining the total jackpot amount based on the retailer sales information;

determining whether said total jackpot amount is at least equal to a threshold, said threshold being equal to a maximum jackpot amount plus an excess jackpot amount;

when said total jackpot amount is at least equal to said threshold, setting a main jackpot at said maximum jackpot amount, said main jackpot associated with a main draw; and determining a number of additional draws and corresponding additional jackpots, each to be won using the same set of elements forming the player selection as for entering in said main draw, using said excess jackpot amount, each additional jackpot being awarded for its corresponding additional draw regardless of whether the main jackpot is won and independently of other additional draws or jackpots;

configuring a random number generator to generate random numbers to create a winning selection for each of the number of additional draws;

communicating the winning selection for each of the number of additional draws for comparison with the set of elements of generated physical lottery tickets; and updating the electronic record representing the pool of available winnings based at least on the winning selections for each of the additional draws, the pool increasing or decreasing in size responsive to winnings of the additional draws and the main jackpot.

* * * * *